US008079673B2

(12) United States Patent
Urasaki

(10) Patent No.: US 8,079,673 B2
(45) Date of Patent: Dec. 20, 2011

(54) DROPLET DISCHARGING HEAD, LIQUID CARTRIDGE, DROPLET DISCHARGING DEVICE, AND IMAGE FORMATION APPARATUS, CONFIGURED WITH ADDITIONAL FLOW PATH CONNECTING COMMOM LIQUID CHAMBER AND LIQUID FLOW PATHS

(75) Inventor: Kohzoh Urasaki, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 682 days.

(21) Appl. No.: 11/897,285

(22) Filed: Aug. 29, 2007

(65) Prior Publication Data

US 2008/0062226 A1 Mar. 13, 2008

(30) Foreign Application Priority Data

Sep. 7, 2006 (JP) ..... 2006-243100
Jul. 18, 2007 (JP) ..... 2007-187538

(51) Int. Cl.
*B41J 2/05* (2006.01)

(52) U.S. Cl. ..... 347/65; 347/92

(58) Field of Classification Search ..... 347/20, 347/44, 47, 56, 61–65, 67, 92–94
See application file for complete search history.

(56) References Cited

U.S. PATENT DOCUMENTS

| | | | | |
|---|---|---|---|---|
| 5,278,585 | A * | 1/1994 | Karz et al. | 347/65 |
| 5,777,649 | A * | 7/1998 | Otsuka et al. | 347/94 |
| 6,402,301 | B1 * | 6/2002 | Powers et al. | 347/63 |

FOREIGN PATENT DOCUMENTS

| | | |
|---|---|---|
| JP | 61-59911 | 3/1986 |
| JP | 2-51734 | 2/1990 |
| JP | 5-50601 | 3/1993 |
| JP | 7-195711 | 8/1995 |
| JP | 7-314670 | 12/1995 |
| JP | 9-207354 | 8/1997 |
| JP | 10-24572 | 1/1998 |
| JP | 10-166587 | 6/1998 |
| JP | 10-315459 | 12/1998 |
| JP | 2002-103645 | 4/2002 |
| JP | 2003-72065 | 3/2003 |

* cited by examiner

*Primary Examiner* — Juanita D Stephens
(74) *Attorney, Agent, or Firm* — Cooper & Dunham LLP

(57) ABSTRACT

A disclosed droplet discharging head includes: a common liquid chamber; a plurality of liquid flow paths branching from the common liquid chamber; a nozzle communicating with the liquid flow path; an actuator substrate having a heater disposed in the vicinity of the nozzle communicating with the liquid flow path; and an additional flow path on a surface above the liquid flow path in the vertical direction, the additional flow path communicating with the common liquid chamber.

18 Claims, 11 Drawing Sheets

DROPLET DISCHARGING HEAD, LIQUID CARTRIDGE, DROPLET DISCHARGING DEVICE, AND IMAGE FORMATION APPARATUS, CONFIGURED WITH ADDITIONAL FLOW PATH CONNECTING COMMOM LIQUID CHAMBER AND LIQUID FLOW PATHS

BACKGROUND

1. Technical Field

This disclosure relates to a droplet discharging head used for a printer, facsimile machine, projector, and the like, a liquid cartridge provided with such a droplet discharging head, and a droplet discharging device on which such a liquid cartridge is installed.

2. Description of the Related Art

Conventionally, a lot of techniques have been researched and known regarding droplet discharging heads, such as droplet discharging heads for discharging liquid resist in a droplet form, droplet discharging heads for discharging a DNA specimen in a droplet form, droplet discharging heads for discharging ink in a droplet form, and the like (refer to Patent Documents 1 to 9, for example).

On an ink-jet (droplet discharging) recording device used as an image recording apparatus (image formation apparatus) such as a printer, facsimile machine, plotter, and the like, there are installed an ink-jet head as a droplet discharging head including a nozzle for discharging an ink droplet, an individual liquid chamber (also referred to as an ink flow path, discharging chamber, liquid pressure chamber, and flow path) communicating with the nozzle, and a driving unit (pressure generating unit) pressurizing ink in the individual liquid chamber. In the following, the ink-jet (droplet discharging) head is mainly described.

Examples of technique for such an ink-jet head include driving units using a piezo-electric element (Patent Document 1), electrostatic force (Patent Document 2), bubble pressure (hereafter referred to as a bubble method) (Patent Document 3), and the like.

Among the above-mentioned techniques, the ink-jet head based on the bubble method includes wiring to which a signal is applied, a heater capable of generating heat via the wiring and of heating ink so as to generate bubbles, and an individual liquid chamber filled with the ink. The ink-jet head discharges the ink from the individual liquid chamber in accordance with bubble generating energy from the heater.

In general, an ink-jet head in which a nozzle axis direction and a flow direction of ink supply are arranged in parallel is referred to as an edge-shooter type and an ink-jet head in which the nozzle axis direction and the flow direction of ink supply are arranged orthogonally to each other is referred to as a side-shooter type.

The edge-shooter type is characterized in that a basic structure is obtained by disposing the heater and the wiring on a flow path plate and attaching a top plate. Thus, the edge-shooter type is suitable for mass production, increase in nozzles, and downsizing.

By contrast, the edge-shooter type has demerits in that a speed of response to refill is slow, discharge power is smaller than that of the side-shooter type, and cavitation is likely to be generated. In accordance with there characteristics, the edge-shooter type had been widely used in the early stages of printers and has been partially employed in line head printers and the like.

On the other hand, in the side-shooter type, a nozzle outlet is positioned directly above the heater, so that an amount of ink is determined by a measure and an amount of discharged ink becomes constant. Further, air bubbles are communicated with the air, so that no cavitation is generated.

In accordance with this, life of the head is improved. Further, a direction where the air bubbles are generated corresponds to a discharge direction, so that the discharge power is enhanced. In addition, a large shock wave is not transmitted to a flow path side, so that the speed of ink refill is fast, and meniscus becomes stable, so that the side-shooter type is suitable for high-speed printing. Currently, the side-shooter type has been mainly employed for printers based on the bubble method.

When using a driving unit based on any of the bubble method, piezo-electric method, electrostatic force method, or the like, there have been increasing demands for ink-jet printers to perform printing of higher image quality, faster speed, and higher reliability in recent years. However, there have been many problems to overcome so as to satisfy these demands.

One of such problems is air bubbles. Some air bubbles remain in an ink supply system upon initial filling of ink and other air bubbles enter upon replacing an ink cartridge. There air bubbles are not particularly problematic as long as they are in a common liquid chamber but pose a problem when these air bubbles are conveyed to the individual liquid chamber via the common liquid chamber.

In other words, air bubbles conveyed to the individual liquid chamber and entered a heater portion absorb pressure for discharging the ink regardless of any of the above-mentioned driving units. This may become a cause of failure of ink discharge. In view of this, various measures have been proposed so as to remove the air bubbles. For example, as a proposal regarding the common liquid chamber, Patent Document 4 discloses an air bubble trap disposed on a top plate of the common liquid chamber so as to prevent the air bubbles from entering the individual liquid chamber.

Patents Documents 5 and 6 disclose a hole for ejecting air bubbles disposed on the common liquid chamber. Patent Document 7 discloses concavity and convexity disposed on a wall surface of the common liquid chamber as the air bubble trap.

Patent Document 8 discloses a flow path dedicated to ejection of air bubbles in which ink and air bubbles experience suction from the flow path by a suction recovery mechanism upon recovery operation of the ink through suction, for example. However, in this case, a structure of a peripheral portion of a printer head becomes complicated, so that cost would be increased.

Patent Document 9 discloses ejection of air bubbles in which air bubbles which have entered the individual liquid chamber are collected using air bubbles generated in a second heater and the air bubbles are ejected by an air bubble ejecting mechanism. However, the structure becomes complicated and cost would also be increased in the same manner as in the above disclosure.

Patent Document 10 discloses a technique in which the air bubble trap is disposed on an opposite side of a heater substrate, a communication hole is formed to the common liquid chamber from the air bubble trap, and air bubbles are conveyed to the communication hole.

Patent Document 1: Japanese Laid-Open Patent Application No. 2-51734

Patent Document 2: Japanese Laid-Open Patent Application No. 5-50601

Patent Document 3: Japanese Laid-Open Patent Application No. 61-59911

Patent Document 4: Japanese Laid-Open Patent Application No. 2002-103645

Patent Document 5: Japanese Laid-Open Patent Application No. 10-166587

Patent Document 6: Japanese Laid-Open Patent Application No. 2003-72065

Patent Document 7: Japanese Laid-Open Patent Application No. 10-315459

Patent Document 8: Japanese Laid-Open Patent Application No. 9-207354

Patent Document 9: Japanese Laid-Open Patent Application No. 7-195711

Patent Document 10: Japanese Laid-Open Patent Application No. 10-024572

However, in these disclosed techniques, although it is possible to remove those air bubbles passing by the vicinity of the air bubble trap to some extent, it is difficult to remove those air bubbles entering the common liquid chamber distant from the air bubble trap and the air bubble ejecting mechanism, namely, air bubbles passing through a central portion of the common liquid chamber. These air bubbles eventually enter the individual liquid chamber and become a cause of failure of discharge.

In this manner, various measures to deal with air bubbles in various techniques which has been disclosed (Patent Documents 1 to 10) have both merits and demerits, so that none of them completely provides an intended effect.

SUMMARY

In an aspect of this disclosure. there is provided a droplet discharging head based on the bubble method, liquid cartridge including such a droplet discharging head, and high-quality droplet discharging (ink-jet) recording device using such a liquid cartridge without discharge failure by realizing a method for removing air bubbles which entered the individual liquid chamber, at low cost.

In another aspect, there is provided a droplet discharging head comprising: a common liquid chamber; a plurality of liquid flow paths branching from the common liquid chamber; a nozzle communicating with the liquid flow path; an actuator substrate having a heater disposed in the vicinity of the nozzle communicating with the liquid flow path; and an additional flow path on a surface above the liquid flow path in the vertical direction, the additional flow path communicating with the common liquid chamber.

In another aspect, in the droplet discharging head, the actuator substrate has a concave portion on a portion of the surface above the liquid flow path in the vertical direction.

In another aspect, in the droplet discharging head, the concave portion is disposed adjacently to the heater on a common liquid chamber side.

In another aspect, in the droplet discharging head, the additional flow path is disposed on a position closest to the heater in the concave portion.

In another aspect, in the droplet discharging head, the additional flow path penetrates through the actuator substrate.

In another aspect, in the droplet discharging head, a convex portion is formed on a surface of the liquid flow path, the surface facing the concave portion.

In another aspect, in the droplet discharging head, a height of the convex portion is within a range from not less than ½ to not more than 2 times a height of the liquid flow path and the convex portion is not in contact with a surface where the concave portion is formed.

In another aspect, in the droplet discharging head, a position of the convex portion disposed in the liquid flow path is located upstream relative to a position of the additional flow path communicating with the common liquid chamber from the concave portion.

In another aspect, in the droplet discharging head, in the additional flow path, a diameter of an opening on a liquid flow path side is larger than a diameter of an opening on a common liquid chamber side and an upstream wall surface is formed to have an inclined surface.

In another aspect, in the droplet discharging head, the additional flow path is formed downstream relative to the heater.

In another aspect, in the droplet discharging head, a check valve preventing an air bubble from flowing backward is disposed in the common liquid chamber.

In another aspect, in the droplet discharging head, the additional flow path communicating with the concave portion and the common liquid chamber is formed by ICP dry etching process.

In another aspect, there is provided a liquid cartridge integrally comprising: a droplet discharging head discharging a droplet and a liquid tank supplying liquid to the droplet discharging head, wherein the droplet discharging head includes the droplet discharging head according to any one of the above-mentioned droplet discharging heads.

In another aspect, there is provided a droplet discharging device comprising: a droplet discharging head discharging a droplet, wherein a liquid cartridge using a droplet discharging head is installed on the droplet discharging device as the droplet discharging head according to any one of the above-mentioned droplet discharging heads.

In another aspect, there is provided an image formation apparatus comprising the above-mentioned droplet discharging device.

In the aforementioned droplet discharging head, the additional flow path communicating with the common liquid chamber is formed on the surface above the liquid flow path in the vertical direction and an air bubble is moved in the opposite direction of gravity. In accordance with this, in the droplet discharging head of the side-shooter type, for example, before the air bubble conveyed to the individual liquid chamber through the liquid flow path enters the heater portion, the air bubble is ejected to the common liquid chamber through the additional flow path. Thus, it is possible to obtain stable discharge without losing discharge pressure from the heater.

Other aspects, features and advantage will become more apparent from the following detailed description when read in conjunction with the accompanying drawings.

DETAILED DESCRIPTION OF THE PREFERRED EMBODIMENTS

In the following, embodiments of the present invention will be described with reference to the accompanying drawings.

In the present embodiment, a droplet discharging head of the side-shooter type is described as a droplet discharging head according to the present invention.

Figure 1:
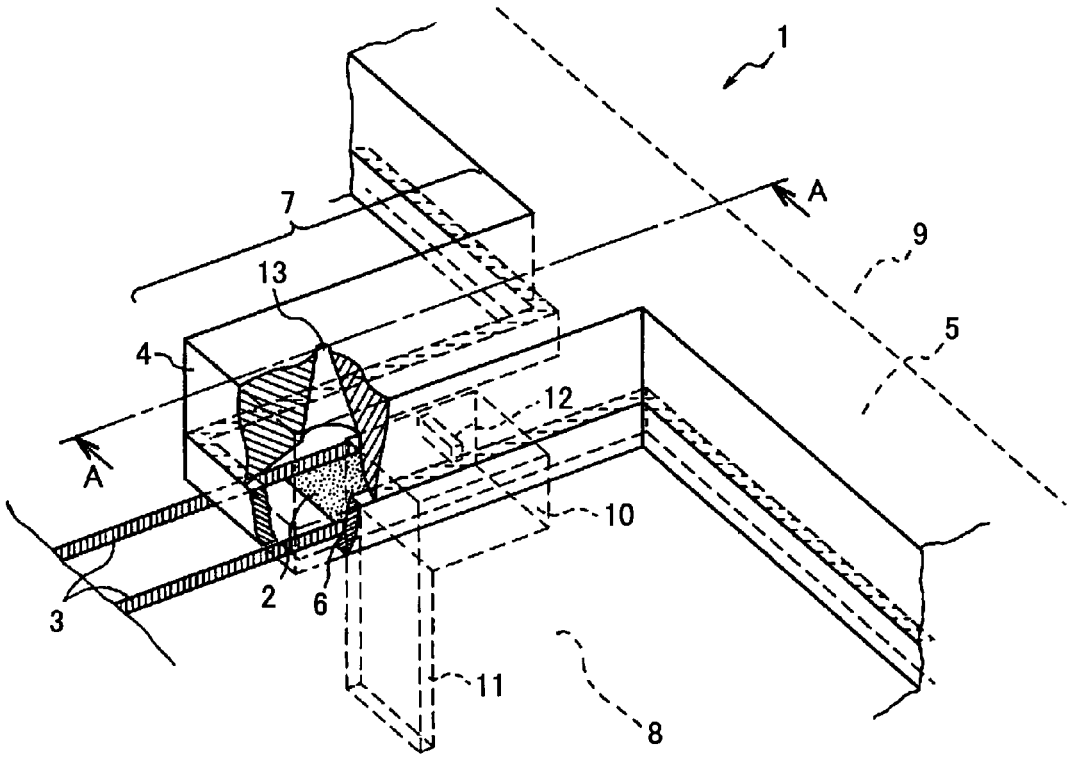
FIG. 1 is a schematic perspective view showing a droplet discharging head according to the present invention.
Figure 2:
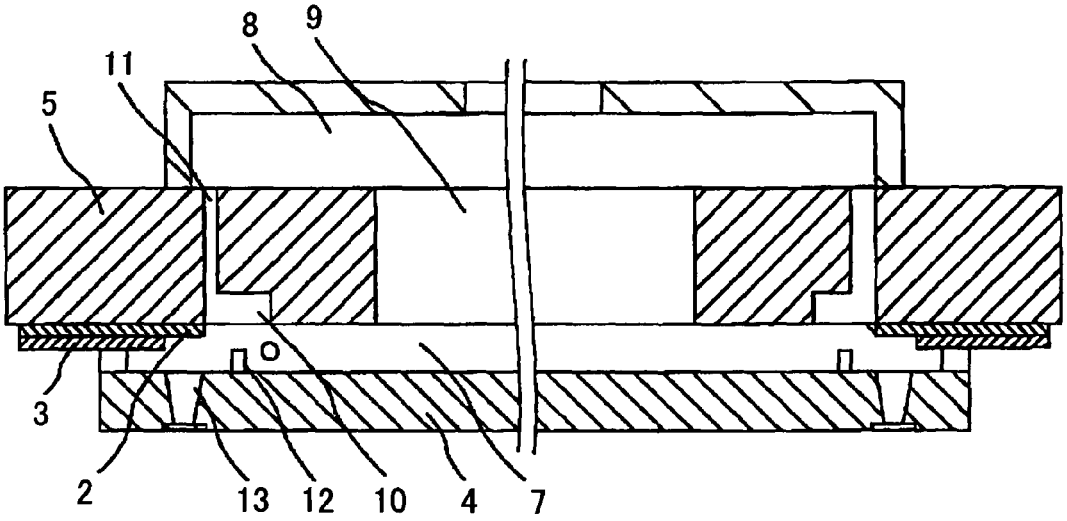
FIG. 2 is a cross-sectional view showing details of an individual liquid chamber of FIG. 1 taken along line A-A.

FIG. 1 is a schematic perspective view showing a droplet discharging head according to a first embodiment of the present invention. FIG. 2 is a cross-sectional view showing details of an individual liquid chamber of FIG. 1 taken along line A-A. In the following, a structure of the present invention and outline of operation are described. FIG. 2 is illustrated such that FIG. 1 is inverted.

A droplet discharging head 1 includes a heater 2 generating thermal energy and an actuator substrate 5 having wiring 3 for applying a signal to the heater 2. A partition 6 forming an individual liquid chamber is disposed on the actuator substrate 5 using photosensitive resin and a nozzle plate 4 made of Ni, for example, and having an ink supplying hole 13 is adhered to an upper portion of the partition 6, thereby forming an individual flow path 7.

Liquid (ink) supplied from common liquid chambers 8 and 9 causes change of state in which a steep increase of volume is accompanied resulting from an effect of the thermal energy from the heater 2 and discharges a droplet from the ink supplying hole 13 in accordance with force based on the change of state.

In this case, an air bubble entering from the common liquid chamber 8 and 9, absorbing discharge pressure, and becoming a factor in failure of discharge is discharged onto the common liquid chamber 8 in accordance with a concave portion 10 and an additional flow path (second flow path) 11 for air bubble ejection formed on the actuator substrate 5 and a convex portion 12 formed on the nozzle plate 4.

Figure 3A:
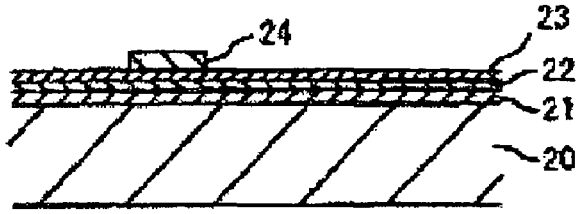
FIGS. 3A through 3F illustrate cross-sectional views of steps of manufacturing a droplet discharging head according to a first embodiment with reference to the cross-sectional view of the liquid chamber shown in FIG. 2.

FIGS. 3A through 3F illustrate cross-sectional views of steps of manufacturing a droplet discharging head with reference to the cross-sectional view of the liquid chamber shown in FIG. 2. First, as shown in FIG. 3A, a thermally-oxidized film 21 is formed with a film thickness of about 1 to 3 μm on a Si substrate 20 as a heat storage layer for efficiently transmitting heat of a heater.

Next, a heating resistive layer 22 to be used as the heater is formed with a film thickness of about 0.3 to 1 μm by electron-beam evaporation or a sputtering method. As materials for the heating resistive layer, metallic boride such as $HfB_2$, $ZrB_2$ are generally used due to preferable properties. However, other materials may be used as long as a desired heat is generated when the materials are energized.

A wiring material layer 23 with low resistance such as aluminum (Al), copper (Cu), or the like is formed with a film thickness of about 0.3 to 1 μm on the heating resistive layer 22 by the electron-beam evaporation or the sputtering method in the same manner as in the heating resistive layer 22.

Figure 3B:
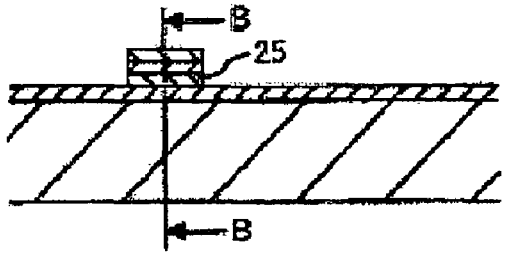

Next, as shown in FIG. 3B, the wiring material layer 23 with low resistance and the heating resistive layer 22 are formed to have a desired wiring pattern 32 by lithography and etching techniques. Further, the wiring material layer 23 with low resistance of the wiring pattern 32 is formed to have a desired heater shape again through patterning by the lithography and etching techniques, so that a heater 25 is formed. FIG. 3 shows a cross-sectional view taken along line B-B.

Figure 3C:
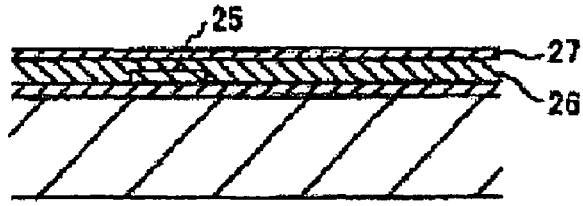

Next, as shown in FIG. 3C, an ink-resistant layer 26 such as $SiO_2$ is formed with a film thickness of about 0.5 to 3 μm and a cavitation-resistant layer 27 such as Ta is formed with a film thickness of about 0.5 to 1 μm by the sputtering method so as to resist cavitation generated upon collapse of ink bubbles, for example.

Figure 3D:
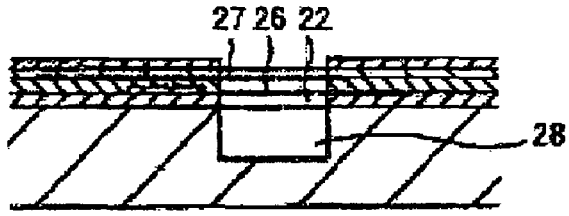

Next, as shown in FIG. 3D, a shape of a concave portion used as an air bubble trap is formed by the lithography technique using a resist pattern. Then, the cavitation-resistant layer 27 and the ink-resistant layer 26 are removed by performing dry etching by a metal dry etching device while the resist pattern is used as a mask.

Next, the thermally-oxidized film 21 is removed by performing dry etching by an oxide film dry etching device, so that the oxide film is opened. In accordance with this, an exposed portion Si is formed into the shape of the concave portion used as an air bubble trap. Then, the Si substrate 20 is etched to a desired depth using an ICP dry etching device. In accordance with this, a concave portion 28 is formed as the air bubble trap.

In this case, by disposing the concave portion 28 on a position which is closest to the heater 25 and is not interfered by the heater 25, it is possible to obtain time for an air bubble entered the individual liquid chamber to move in the opposite direction of gravity. In accordance with this, the air bubble is more likely to be captured in the trap.

Further, in accordance with this, it is possible to reduce a size of the individual liquid chamber, so that it is possible to downsize the head and realize low cost. In this case, the common liquid chamber not shown in the drawings is also processed at the same time in the same manner as in the concave portion 28.

Figure 3E:
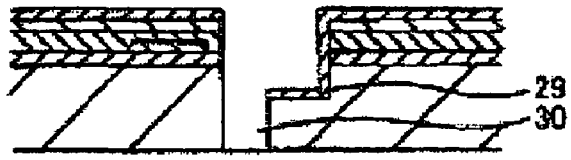

Next, as shown in FIG. 3E, patterning 29 of a flow path for allowing the concave portion 28 to communicate with the common liquid chamber is applied to a bottom of the concave portion 28 by the lithography technique. In this case, when a step of the concave portion 28 is deep from a surface, a spray coater is effectively used upon coating the resist pattern.

Next, the substrate is penetrated by a dry etching technique by an ICP etcher (dry etching device) and a flow path 30 for air bubble ejection is completed. In this case, the common liquid chamber not shown in the drawings is also subjected to the etching for penetrating the substrate in the same manner as mentioned above and the common liquid chamber is completed.

The flow path 30 for air bubble ejection is disposed on a position most efficient in ejection, so that stable capability of air bubble ejection is obtained. Moreover, the flow path 30 for air bubble ejection has a shape most readily available for processing, so that it is possible to obtain a droplet discharging head at low cost.

In the dry etching by the ICP etcher, it is effective to use the Bosch process in which etching and deposition process are alternately switched and the etching is performed while a side wall is protected.

Specifically, in the etching step, it is possible to obtain a preferable shape on condition that pressure is within a range from 100 to 200 mT, coil power from 2000 to 3000 W, time of a single cycle etching from 7 to 10 seconds, $SF_6$ flow rate from 300 to 500 sccm, platen power from 60 to 100 W, pressure from 20 to 50 mT in a deposition step, coil power from 1800 to 2500 W, deposition time of a single cycle from 3 to 5 seconds, and $C_4F_8$ flow rate from 100 to 200 sccm.

Figure 3F:
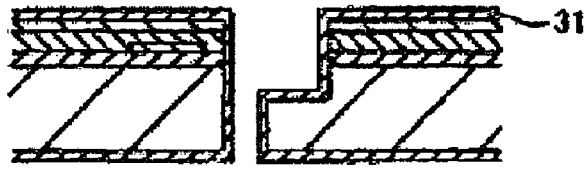
Figure 3:
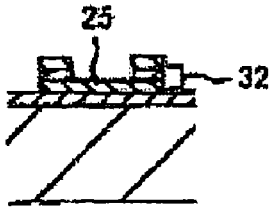
FIG. 3 illustrates a cross-sectional view taken along line B-B in FIG. 3B.

Next, as shown in FIG. 3F, after the resist is removed, a film having resistance to ink such as poly-para-xylylene is deposited by a deposition device. In accordance with this, a film 31 is completed in which even a portion processed in the ICP etching has resistance to ink.

The substrate manufactured in the above-mentioned method includes the concave portion for trapping air bubbles and the flow path for air bubble ejection, so that it is possible to obtain a droplet discharging head capable of performing high-quality and stable printing.

The substrate is formed using deep Si etching through dry etching, so that the manufacturing process is stable and superior in mass productivity. Thus, it is possible to manufacture a droplet discharging head having high reliability at low cost.

The present embodiment is described based on the example where the concave portion 10 and the flow path 11 for air bubble ejection are formed through dry etching. However, other than dry etching, wet etching, or dry etching and wet etching may be used in combination so as to form the concave portion 10 and the flow path 11 for air bubble ejection.

FIGS. 4A through 4F illustrate cross-sectional views of steps of manufacturing a droplet discharging head according to a second embodiment with reference to the cross-sectional view of the liquid chamber shown in FIG. 2. First, a method for forming a convex portion on a surface facing the concave portion of a liquid flow path is described.

Figure 4A:
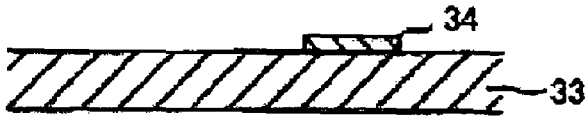
FIGS. 4A through 4F illustrate cross-sectional views of steps of manufacturing a droplet discharging head according to a second embodiment with reference to the cross-sectional view of the liquid chamber shown in FIG. 2.
Figure 4B:
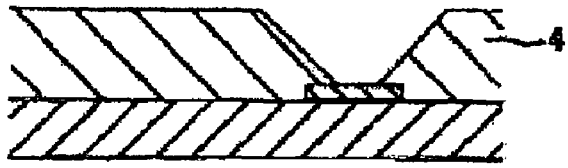

As shown in FIG. 4A, a resist pattern 34 for nozzle opening is formed on a SUS substrate 33 to have a desired size by the lithography technique. Next, as shown in FIG. 4B, Ni is formed to have a desired thickness by Ni electroforming technique, so that the nozzle plate 4 is formed.

Figure 4C:
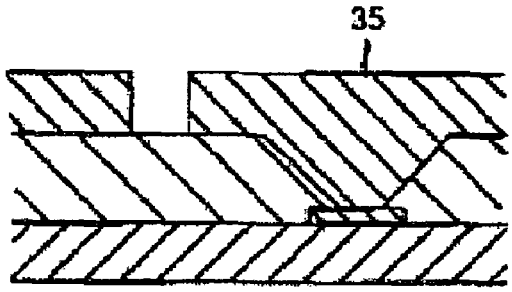

Next, as shown in FIG. 4C, a resist pattern 35 is formed such that a desired shape of the convex portion is formed as an opening portion. In this case, a position of the convex portion in the resist pattern faces the concave portion 10 formed on the actuator substrate 5 to which the nozzle plate 4 shown in FIG. 4 is applied and a thickness of the resist is not less than a height of the desired convex portion.

Figure 4D:
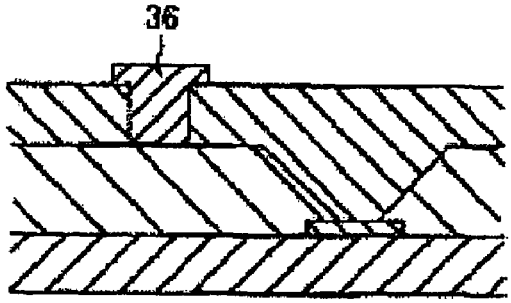
Figure 4E:
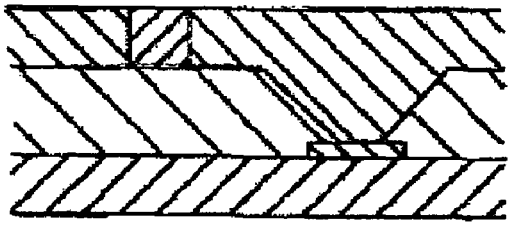
Figure 4F:
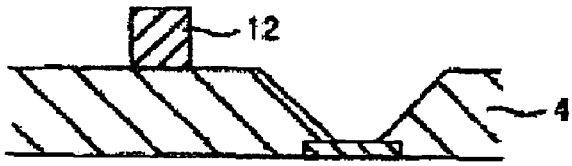

Next, as shown in FIG. 4D, Ni is formed by the Ni electroforming technique again, so that a convex portion 36 is formed. Then, as shown in FIG. 4E, the convex portion is processed to have a desired height through grinding. Finally, as shown in FIG. 4F, the resist is removed, so that the nozzle plate 4 with the convex portion 12 is completed.

Next, a method for forming the individual liquid chamber is described using the nozzle plate 4 on which the convex portion 12 is formed with reference to FIG. 1. First, the partition 6 forming the individual liquid chamber is disposed on the actuator substrate 5 by the lithography technique using photosensitive resin, the actuator substrate 5 being completed in the first embodiment mentioned above. Then, adhesive is coated onto the partition 6 by screen printing technique or the like and the nozzle plate 4 with the convex portion 12 is applied to the partition 6.

In this case, the convex portion 12 is formed on the nozzle plate 4 so as to have a positional relationship such that the convex portion 12 faces the concave portion 10 of the actuator substrate 5. In accordance with this, in the individual liquid chamber (liquid flow path) 7, an air bubble entered the individual liquid chamber 7 is guided to the concave portion 10 for trapping air bubbles in accordance with the convex portion 12, so that it is possible to efficiently eject the air bubble and improve ejection efficiency. Thus, it is possible to obtain a droplet discharging head having stable capability of air bubble ejection.

FIGS. 5A to 5E are cross-sectional views showing details of the individual liquid chamber of the droplet discharging head according to the present embodiment. The droplet discharging head shown in FIGS. 5A to 5E include the nozzle opening portion 13, nozzle plate 4, heater 2, actuator substrate 5, concave portion 10 for trapping air bubbles, flow path 11 for air bubble ejection, and individual liquid chamber 7.

Figure 5A:
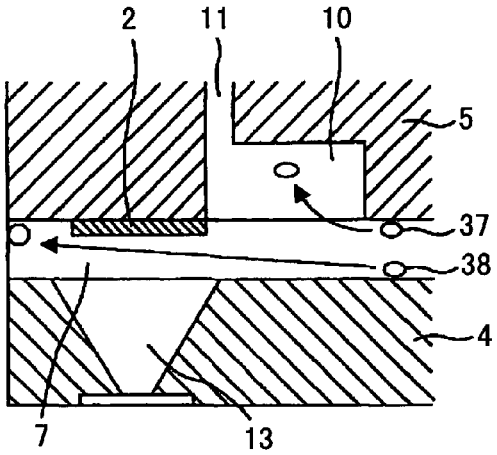
FIG. 5A is a cross-sectional view showing a flow of an air bubble when a surface facing a concave portion has no convex portion.
Figure 5B:
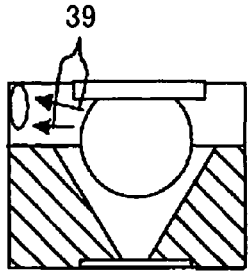
FIG. 5B is a cross-sectional view showing bubble generating pressure of a heater.

FIG. 5A shows a flow of an air bubble when the surface facing the concave portion 10, namely, a nozzle surface has no convex portion with reference to a cross-sectional view showing a bubble generating pressure 39 in the heater 2. Since the air bubble moves in the opposite direction of gravity as a natural phenomenon, so that an air bubble 37 entering from a relatively upper portion of the individual liquid chamber 7 is naturally guided to the concave portion 10 for trapping air bubbles and the air bubble 37 does not enter the heater portion.

However, in some cases, an air bubble 38 entering from a lower portion of the individual liquid chamber 7 passes by the concave portion 10 for trapping air bubbles without being captured therein. As a result, the air bubble 38 enters the heater portion where the heater 2 is disposed. The air bubble 38 entered the heater portion absorbs the bubble generating pressure 39 from the heater 2, so that the air bubble 38 may become a cause of failure of discharge.

Figure 5C:
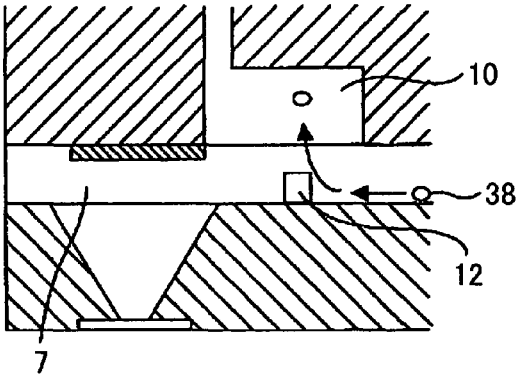
FIG. 5C is a cross-sectional view showing a flow of an air bubble when a nozzle surface has a convex portion and the air bubble enters from a lower portion of an individual liquid chamber.

However, as shown in FIG. 5C, when the nozzle surface has the convex portion 12 disposed thereon, the air bubble 38 entering from the lower portion of the individual liquid chamber 7 collides with the convex portion 12, so that the air bubble 38 is pressed upward and captured in the concave portion 10 for trapping air bubbles.

Figure 5D:
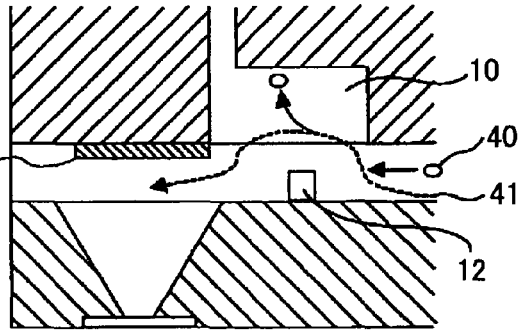
FIG. 5D is a cross-sectional view showing a flow of an air bubble when a nozzle surface has a convex portion an air bubble enters from a middle portion of an individual liquid chamber.

Further, as shown in FIG. 5D, when an air bubble 40 enters from a middle portion of the individual liquid chamber 7, a flow 41 of liquid is guided to the concave portion 10 for trapping air bubbles in accordance with the convex portion 12, so that the air bubble 40 is guided to the concave portion 10 for trapping air bubbles in accordance with interaction between such characteristics of the air bubble 40 as movement in the opposite direction of gravity and the flow of liquid. In accordance with this, it is possible to efficiently eject the air bubble, so that it is possible to obtain a stable droplet discharging head.

Figure 5E:
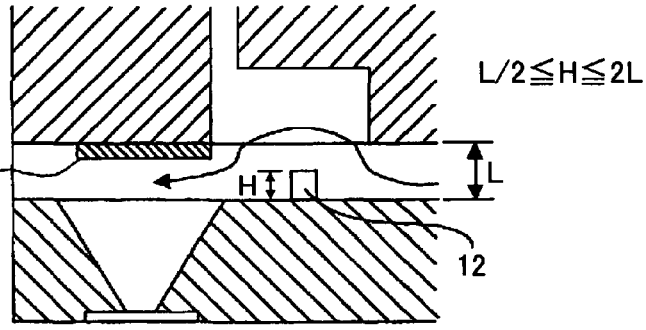
FIG. 5E is a cross-sectional view showing an effect of a convex portion maximized when a height H of the convex portion is within a range from not less than a half of a height L of an individual liquid chamber to not more than two times the height L.

In this case, as shown in FIG. 5E, it is confirmed in an experiment that the effect of the convex portion 12 is maximized when a height H of the convex portion 12 is within a range from not less than a half of a height L of the individual liquid chamber 7 to not more than two times the height L taking into consideration efficiency of liquid refill to the heater 2 after discharge.

Accordingly, the height H of the convex portion 12 is most effective when the height is within a range from ½ to 2 times the height L of the individual liquid chamber 7. However, the convex portion 12 is not in contact with a surface where the concave portion 10 for the individual liquid chamber 7 is formed.

In this manner, a relative relationship between the height of the convex portion and the height of the individual liquid chamber is adjusted to be most suitable for air bubble ejection, so that it is possible to obtain stable capability of air bubble ejection. In addition, a method for forming the convex portion 12 is omitted here since it is described above.

Figure 6A:
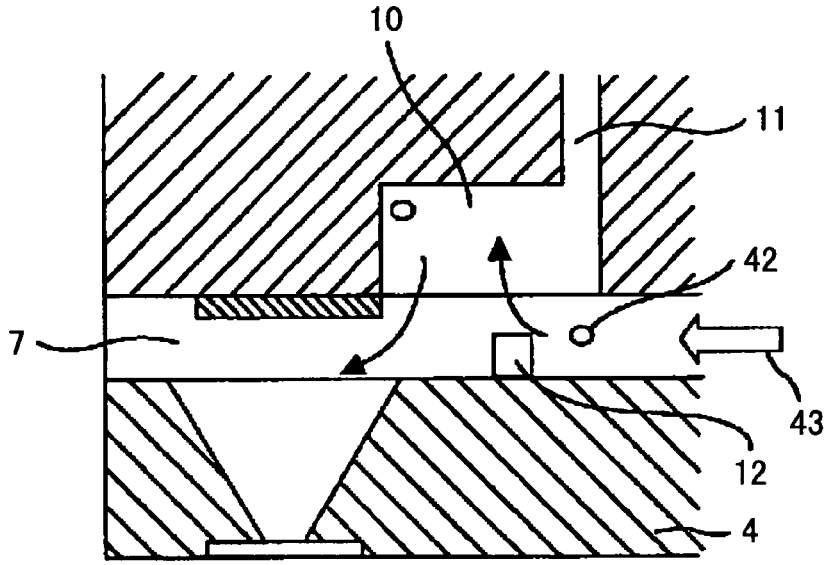
FIG. 6A is a cross-sectional view showing a positional relationship between a convex portion formed on a nozzle plate and a flow path for air bubble ejection formed on a concave portion of an actuator substrate in a case where the convex portion is positioned on a heater side relative to the flow path for air bubble ejection.
Figure 6B:
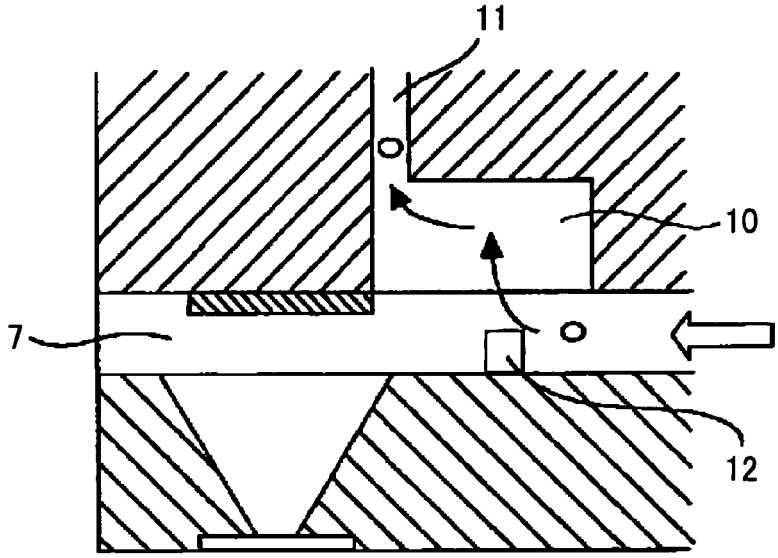
FIG. 6B is a cross-sectional view showing a positional relationship between a convex portion formed on a nozzle plate and a flow path for air bubble ejection formed on a concave portion of an actuator substrate in a case where the flow path for air bubble ejection is positioned on a heater side relative to the convex portion.

FIGS. 6A and 6B are cross-sectional views showing a positional relationship between the convex portion formed on the nozzle plate and the flow path for air bubble ejection formed on the concave portion of the actuator substrate. FIGS. 6A and 6B show the positional relationship between the convex portion 12 formed on the nozzle plate 4 and the flow path 11 for air bubble ejection formed on the concave portion 10 of the actuator substrate 5.

FIG. 6A shows a case where the convex portion 12 is positioned on a heater side relative to the flow path 11 for air bubble ejection. In this case, an air bubble 42 is guided to the concave portion 10 for trapping air bubbles in accordance with the convex portion 12. However, the air bubble 42 is conveyed downstream in a flow 43 of liquid, so that the air bubble 42 is less likely to reach the flow path 11 for air bubble ejection and is held in the concave portion 10 for trapping air bubbles.

Although this situation is less likely to cause a problem in a normal status, when pressure in the individual flow path 7 is changed or a status of liquid supply is changed, for example, the air bubble which has been captured in the concave portion for trapping air bubbles may be out of the concave portion and conveyed to the heater portion.

By contrast, as shown in FIG. 6B, when the flow path 11 for air bubble ejection is positioned on the heater side relative to the convex portion 12, the air bubble guided to the concave portion 10 for trapping air bubbles is naturally conveyed to the flow path 11 for air bubble ejection in accordance with the flow of liquid, so that it is possible to securely remove the air bubble captured in the concave portion for trapping air bubbles. Accordingly, the relative relationship between the convex portion 12 and the concave portion 10 for trapping air bubbles becomes most suitable in terms of efficiency of air bubble ejection. Thus, it is possible to obtain a droplet discharging head having stable capability of air bubble ejection. In addition, a method for forming the convex portion 12 and the flow path 11 for air bubble ejection is omitted here since it is described above.

Next, other embodiments of the droplet discharging head according to the present invention are described. In the droplet discharging head described in the following, the same reference numerals as in FIGS. 1 and 2 are assigned to the same portions and description thereof is omitted.

Figure 7:
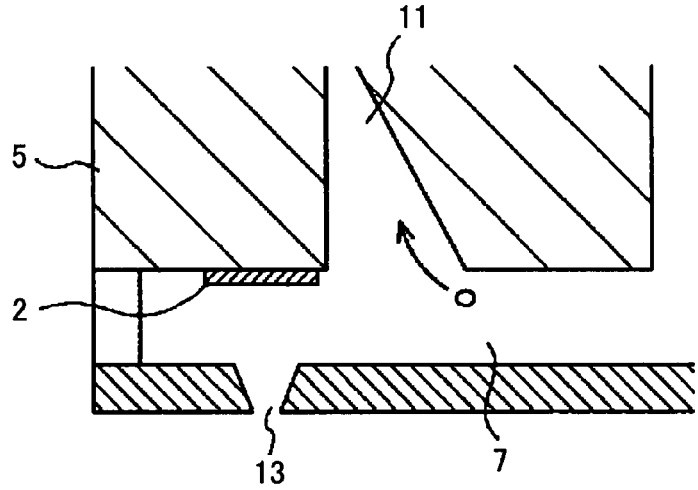
FIG. 7 is a diagram schematically showing a structure of a droplet discharging head according to a second embodiment of the present invention.

FIG. 7 is a diagram schematically showing a structure of a droplet discharging head according to a second embodiment of the present invention. In the droplet discharging head shown in FIG. 7, a diameter of an opening on an air bubble inflow side (individual flow path 7 side) of the flow path 11 for air bubble ejection (second flow path) is larger than a diameter of an opening on an air bubble ejection side (common liquid chamber 8 side). Further, a wall surface of the flow path 11 for air bubble ejection positioned upstream is formed to have an inclined surface t. When the droplet discharging head is constructed in this manner, it is also possible to readily eject the air bubble from the individual flow path 7 side to the common liquid chamber 8 side in the same manner as in the droplet discharging head 1 according to the first embodiment shown in FIGS. 1 and 2.

Moreover upon manufacturing the droplet discharging head, it is not necessary to form the concave portion 10 on the actuator substrate 5. Thus, the droplet discharging head according to the present embodiment has a merit in that only a single etching process is required in comparison with the etching process performed twice on the actuator substrate 5 so as to form the flow path 11 for air bubble ejection and the concave portion 10 in the droplet discharging head 1 according to the first embodiment.

Figure 8:
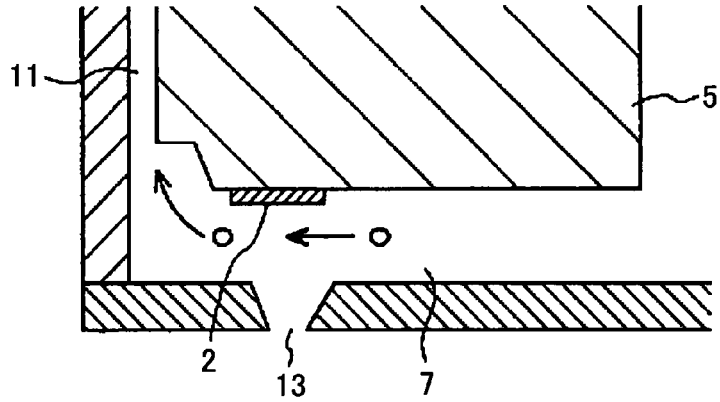
FIG. 8 is a diagram schematically showing a structure of a droplet discharging head according to a third embodiment of the present invention.

FIG. 8 is a diagram schematically showing a structure of a droplet discharging head according to a third embodiment of the present invention. The droplet discharging head shown in FIG. 8 includes the flow path 11 for air bubble ejection formed downstream relative to the heater 2. When the droplet discharging head is constructed in this manner, even if the air bubble enters the heater portion where the heater 2 is disposed, it is possible to eject the entered air bubble to the common liquid chamber 8 through the flow path 11 for air bubble ejection.

Figure 9:
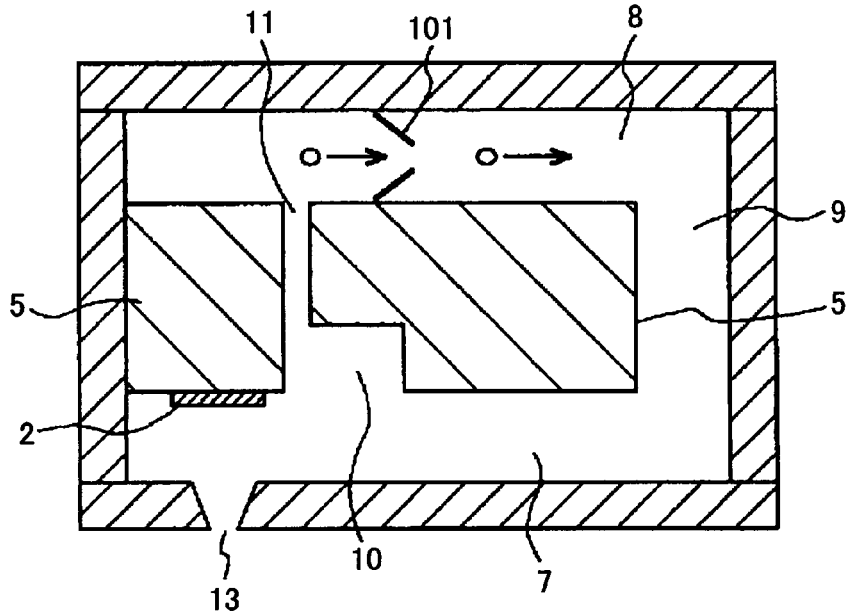
FIG. 9 is a diagram schematically showing a structure of a droplet discharging head according to a fourth embodiment of the present invention.

FIG. 9 is a diagram schematically showing a structure of a droplet discharging head according to a fourth embodiment of the present invention. The droplet discharging head shown in FIG. 9 includes a check valve 101 disposed on the common liquid chamber 8, the check valve 101 preventing an air bubble from flowing backward. When the droplet discharging head is constructed in this manner, it is possible to prevent the air bubble from flowing backward to the individual flow path 7 through the flow path 11 for air bubble ejection.

Figure 10A:
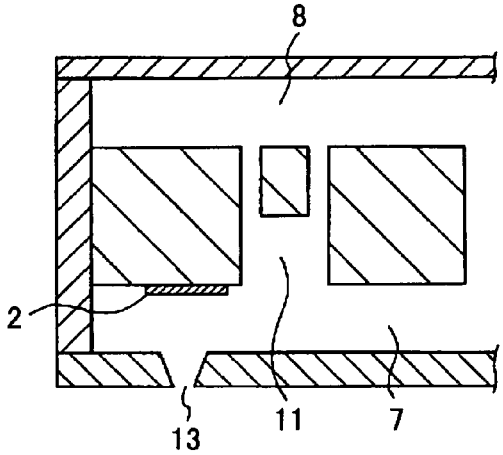
FIG. 10A is a diagram schematically showing a structure of a droplet discharging head according to a fifth embodiment of the present invention.

FIG. 10A is a diagram schematically showing a structure of a droplet discharging head according to a fifth embodiment of the present invention. In the droplet discharging head shown in FIG. 10A, the flow path 11 for air bubble ejection is formed such that the diameter of the opening on the individual flow path 7 side is larger than the diameter of the opening on the common liquid chamber 8 side. Further, plural openings are formed on the common liquid chamber 8 side. When the flow path 11 for air bubble ejection is formed in this manner, it is possible to readily eject the air bubble on the individual flow path 7 side to the common liquid chamber 8 side while reducing loss of pressure on the individual flow path 7 side.

Figure 10B:
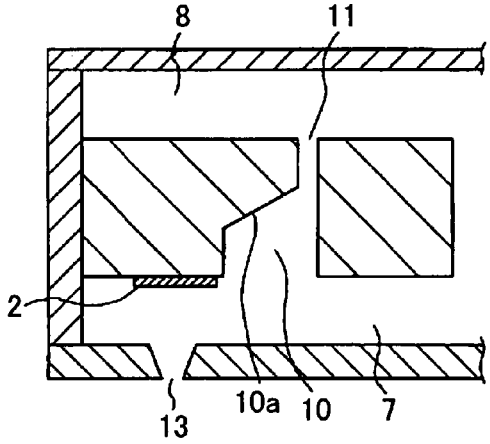
FIG. 10B is a diagram schematically showing a structure of a droplet discharging head according to a sixth embodiment of the present invention.

FIG. 10B is a diagram schematically showing a structure of a droplet discharging head according to a sixth embodiment of the present invention. In the droplet discharging head shown in FIG. 10B, an upper surface of the concave portion 10 is formed partially on a surface on an upper side of the individual flow path 7 in the vertical direction as a tapered surface (inclined surface) 10*a*. When the droplet discharging head is constructed in this manner, the air bubble is guided to the flow path 11 for air bubble ejection in accordance with the tapered surface 10*a* formed on the concave portion 10. Thus, it is possible to readily eject the air bubble to the common liquid chamber 8 side.

Figure 10C:
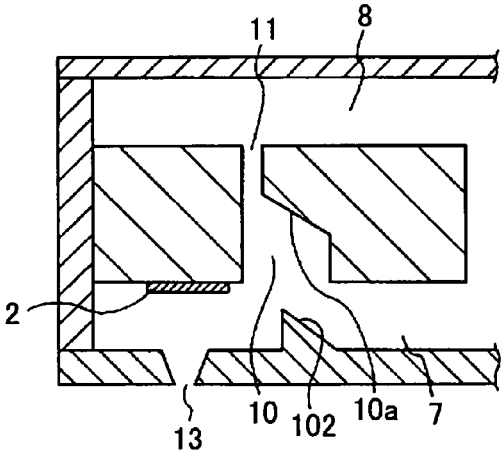
FIG. 10C is a diagram schematically showing a structure of a droplet discharging head according to a seventh embodiment of the present invention.

FIG. 10C is a diagram schematically showing a structure of a droplet discharging head according to a seventh embodiment of the present invention. In the droplet discharging head shown in FIG. 10C, the upper surface of the concave portion 10 is formed partially on the surface on the upper side of the individual flow path 7 in the vertical direction as a tapered surface (inclined surface) 10*a*. In addition, on a surface on a lower side of the individual flow path 7 in the vertical direction, a protrusion 102 is formed at a position for the flow path 11 for air bubble ejection such that the protrusion 102 has an inclination as shown in FIG. 10C. When the droplet discharging head is constructed in this manner, the air bubble of the individual flow path 7 is guided to the flow path 11 for air bubble ejection in accordance with the inclination of the protrusion 102. Thus, a flow the air bubble becomes smooth and it is possible to improve the efficiency of air bubble ejection.

Figure 10D:
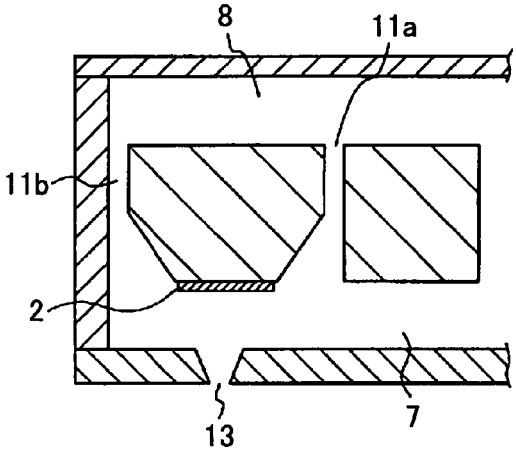
FIG. 10D is a diagram schematically showing a structure of a droplet discharging head according to an eighth embodiment of the present invention.

FIG. 10D is a diagram schematically showing a structure of a droplet discharging head according to an eighth embodiment of the present invention. In the droplet discharging head shown in FIG. 10D, flow paths 11*a* and 11*b* for air bubble ejection are formed upstream and downstream relative to the heater 2 respectively. When the droplet discharging head is constructed in this manner, even if the air bubble enters the heater portion where the heater 2 is disposed, it is possible to eject the entered air bubble to the common liquid chamber 8 through the flow path 11*b* for air bubble ejection.

Figure 10E:
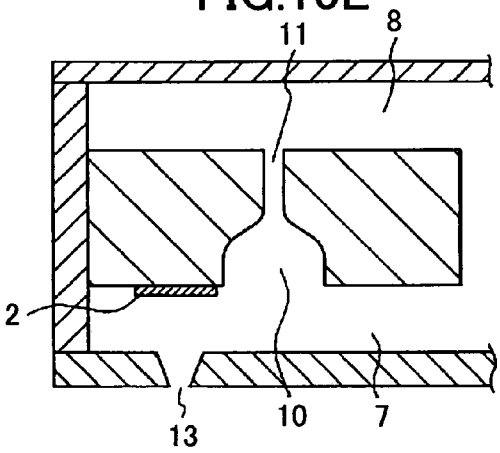
FIG. 10E is a diagram schematically showing a structure of a droplet discharging head according to a ninth embodiment of the present invention.

FIG. 10E is a diagram schematically showing a structure of a droplet discharging head according to a ninth embodiment of the present invention. In the droplet discharging head shown in FIG. 10E, the flow path 11 for air bubble ejection is formed on a substantially middle portion of the concave portion 10. In addition, as shown in FIG. 10E, the upper surface of the concave portion 10 is formed as the tapered surface (inclined surface) 10*a*. When the droplet discharging head is constructed in this manner, it is possible to form the flow path 11 for air bubble ejection distantly from the heater 2 and provide a structure preferable for maintaining strength of the actuator substrate 5.

Figure 11A:
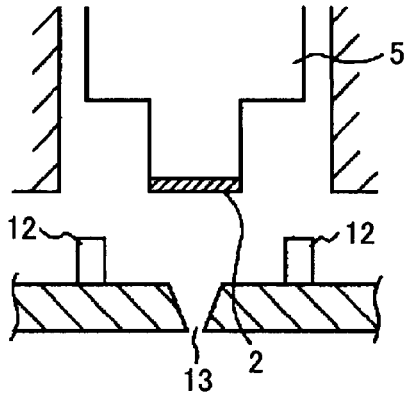
FIG. 11A is a cross-sectional view schematically showing a structure of a droplet discharging head according to a tenth embodiment of the present invention.
Figure 11B:
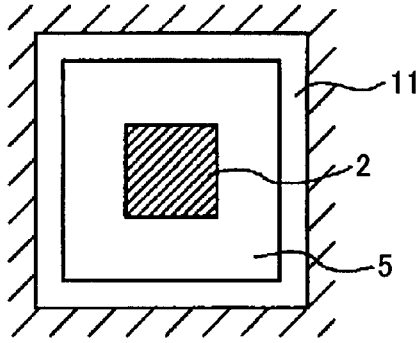
FIG. 11B is a plan view of a heater portion schematically showing a structure of a droplet discharging head according to a tenth embodiment of the present invention.

FIGS. 11A and 11B are diagrams showing a schematic structure of a droplet discharging head according to a tenth embodiment of the present invention. FIG. 11A is a cross-sectional view and FIG. 11B is a plan view of a heater portion. In the droplet discharging head shown in FIG. 11A and 11B, a step is disposed on a peripheral portion of the heater 2 when the flow path 11 for air bubble ejection is formed. In other words, the heater 2 is formed in an insular manner. In addition, on the surface on the lower side of the individual flow path 7 in the vertical direction, a protrusion 12 is formed at a position corresponding to the flow path 11 for air bubble ejection. When the droplet discharging head is constructed in this manner, it is possible to securely eject the air bubble of the individual flow path 7 to the common liquid chamber 8. Moreover, the convex portion 12 is formed at the position corresponding to the flow path 11 for air bubble ejection, so that it is possible to prevent pressure in the individual flow path 7 from being flown out.

In the present embodiment, although the droplet discharging head of the side-shooter type is described as the example of the droplet discharging head, this is intended to be an example and it is possible to apply the present embodiment to a droplet discharging head of the edge-shooter type.

Figure 12:
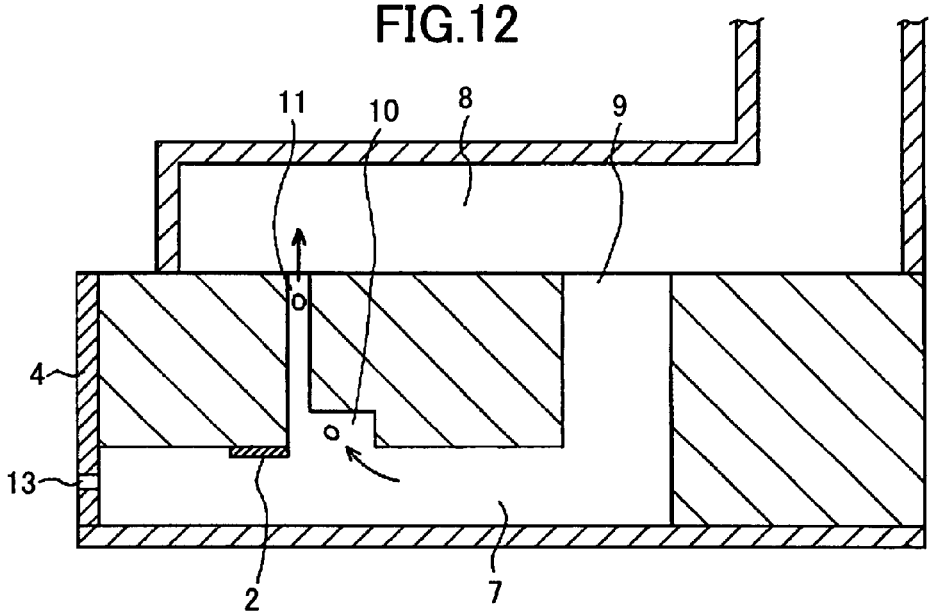
FIG. 12 is a diagram schematically showing a structure of a droplet discharging head of an edge-shooter type to which the present invention is applied.

FIG. 12 is a diagram schematically showing a structure of a droplet discharging head of the edge-shooter type to which the present invention is applied. As shown in FIG. 12, in the droplet discharging head of the edge-shooter type, the ink supplying hole 13 is formed on a position such that an axial direction of the ink supplying hole 13 and a flow direction of ink supply are arranged in parallel.

Figure 13:
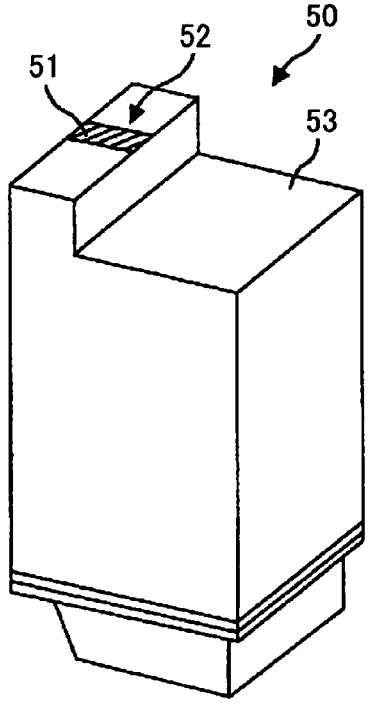
FIG. 13 is a schematic diagram showing a liquid cartridge in which a droplet discharging head discharging a droplet and a liquid tank supplying liquid to the droplet discharging head are integrated.

FIG. 13 is a schematic diagram showing a liquid cartridge in which a droplet discharging head discharging a droplet and a liquid tank supplying liquid to the droplet discharging head are integrated. In FIG. 13, a liquid cartridge 50 is prepared by integrating a droplet discharging head 52 according to any one of the above-mentioned embodiments having a nozzle 51 and the like with a liquid tank 53 supplying liquid to the droplet discharging head 52.

In the droplet discharging head integrated with the liquid tank as in this case, capability of the droplet discharging head is directly linked to capability of an entire portion of the liquid cartridge 50. In accordance with this, by using the high dense and long droplet discharging head as mentioned above, it is possible to realize a liquid cartridge superior in productivity and having capability of high reliability, high image quality, and high speed recording.

Figure 14:
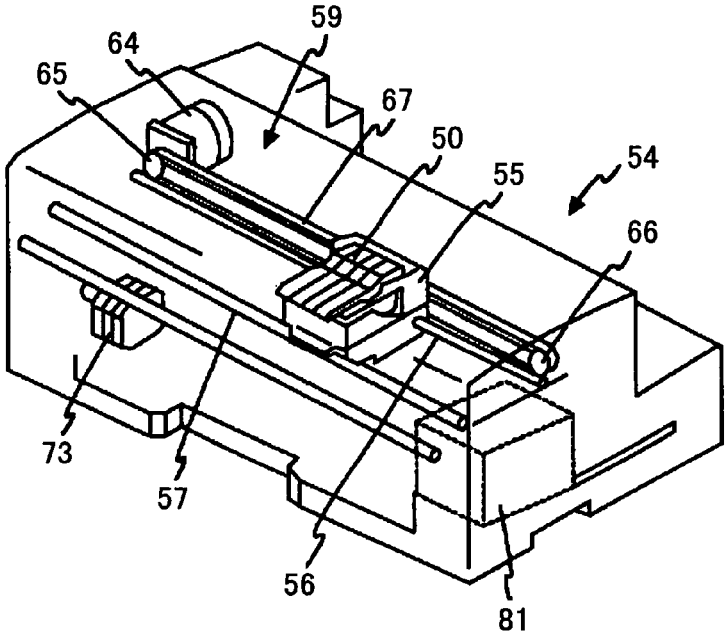
FIG. 14 is a schematic perspective view showing an ink-jet recording device.

FIG. 14 is a schematic perspective view showing an ink-jet recording device.

Figure 15:
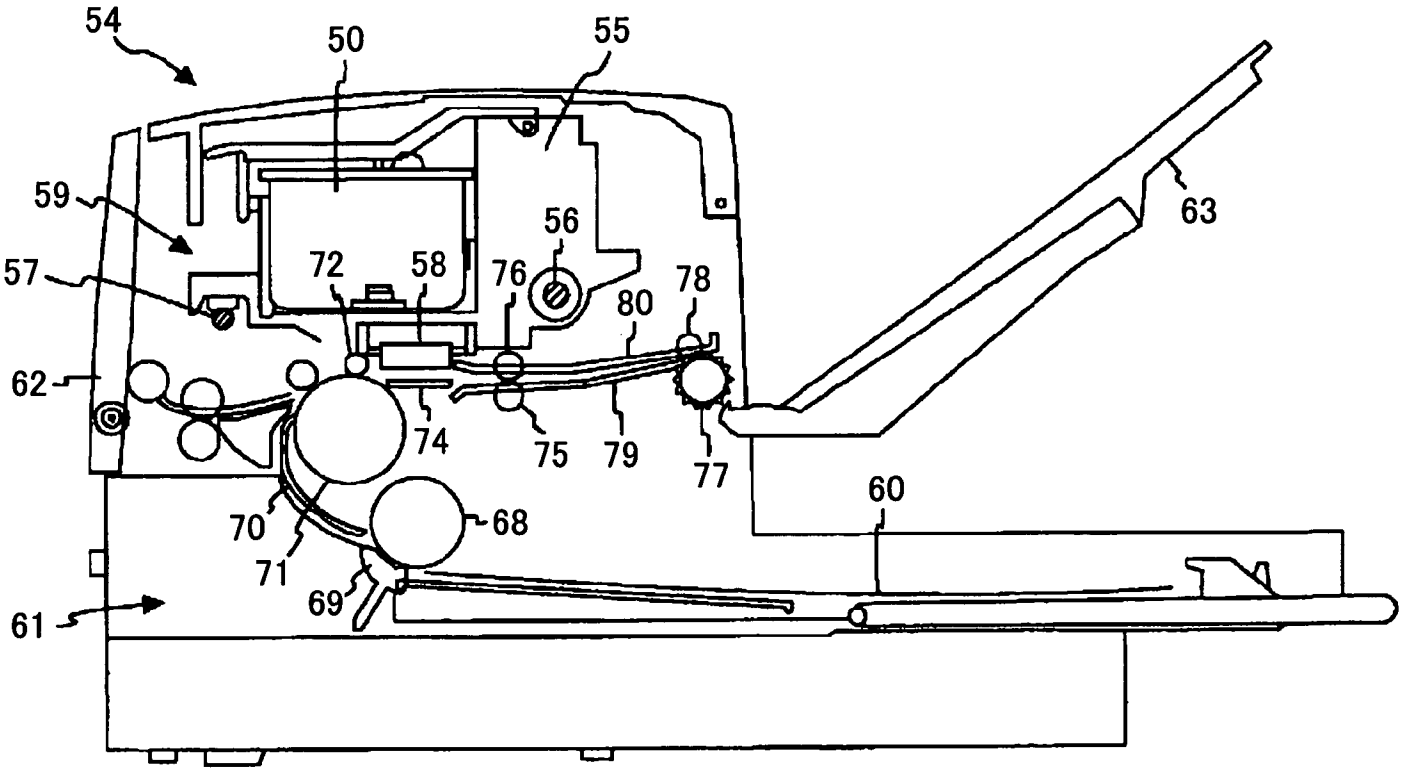
FIG. 15 is a side elevational view showing a mechanical unit of the ink-jet recording device of FIG. 14.

FIG. 15 is a side elevational view showing a mechanical unit of the ink-jet recording device of FIG. 14.

With reference to FIG. 14 and FIG. 15, an ink-jet recording device 54 houses, in an internal portion thereof, a mechanical unit 59 including a carriage 55 capable of moving in a main scanning direction, a recording head 58 installed on the carriage 55 and having the ink-jet head according to the present invention, the ink cartridge 50 supplying ink to the recording head 58, and the like.

Below the ink-jet recording device 54, it is possible to detachably install a paper feed cassette (or paper feed tray) 61 from a front side, the paper feed cassette 61 being capable of loading multiple sheets of paper 60.

Further, it is possible to open and fall the paper feed cassette 61 for manually feeding the paper 60. After the paper 60 fed from the paper feed cassette 61 or a manual feed tray 62 is taken in and a required image is recorded by the printing mechanical unit 59, the paper 60 is ejected to a paper ejection tray 63 installed on a rear side.

The printing mechanical unit 59 slidably holds the carriage 55 using a main guide rod 56 and a sub-guide rod 57 in the main scanning direction (vertical direction relative to the diagram of FIG. 15).

The droplet discharging heads 58 including the ink-jet heads according to the present invention discharging ink droplets of each color of yellow (Y), cyan (C), magenta (M), and black (K) are installed on the carriage 55 such that plural ink discharge outlets (nozzles) are arranged in a direction orthogonal to the main scanning direction and an ink discharging direction is directed downward. Further, liquid cartridges 50 for supplying ink of each color to the recording heads 58 are replaceably installed on the carriage 55.

The liquid cartridge 50 includes an atmospheric outlet communicating with the air in an upper portion thereof, a supply outlet supplying ink to the ink-jet (droplet discharging) head in a lower portion thereof, and a porous body filled with ink in an internal portion thereof. The liquid cartridge 50 maintains the ink to be supplied to the ink-jet head under a slight negative pressure in accordance with capillary force of the porous body.

Although the droplet discharging heads 58 of each color are used as recording heads, it is possible to use a single head having a nozzle discharging ink droplets (droplets) of each color.

In this case, a rear side (downstream side of the paper conveying direction) of the carriage 55 is slidably fitted into the main guide rod 56 and a front side (upstream side of the paper conveying direction) of the carriage 55 is slidably placed on the sub-guide rod 57.

In addition, a timing belt 67 is installed between a driving pulley 65 rotated by a main scanning motor 64 and a driven pulley 66 so as to perform movement and scanning of the carriage 55 and the timing belt 67 is fixed on the carriage 55. The carriage 55 is driven for reciprocation in accordance with rotation and reverse rotation of the main scanning motor 64.

On the other hand, in order to convey the paper 60 set in the paper feed cassette 61 to a position below the recording head 58, there are disposed a paper feed roller 68 and a friction pad 69 separating and feeding the paper 60 from the paper feed cassette 61, a guide member 70 guiding the paper 60, and a tip runner 72 regulating a degree of feeding of the paper 60 from a conveyance roller 71 inverting and feeding the fed paper 60. The conveyance roller 71 is driven for rotation by a sub-scanning motor 73 via a gear array.

Further, a print reception member 74 is disposed as a paper guide member, guiding the paper 60 fed from the conveyance roller 71 below the droplet discharging head 58 in accordance with a range of movement of the carriage 55 in the main scanning direction.

Moreover, a conveying runner 75 and a spur 76 driven for rotation so as to feed the paper 60 in a paper ejection direction are disposed downstream relative to the print reception member 74 in the paper conveying direction. In addition, there are disposed a paper ejection roller 77 and a spur 78 feeding the paper 60 to a paper ejection tray 63, and guide members 79 and 80 forming an ejection path.

Upon recording, by driving the droplet discharging head 58 in response to an image signal while moving carriage 55, ink is discharged onto the stationary paper 60 and recording is performed for a single row. After the paper 60 is conveyed as long as a predetermined length, recording is performed for the next row. When a recording end signal or a signal indicating that a rear end of the paper 60 has reached a recording area is received, the recording operation is ended and the paper 60 is ejected.

At a position off the recording area on a right end of a movement direction of the carriage 55, there is disposed a recovery device 81 recovering from failure of discharge in the droplet discharging head 58. The recovery device 81 includes a cap unit, suction unit, and cleaning unit.

The carriage 55 is moved to the recovery device 81 while waiting for printing, where the droplet discharging head 58 is capped with the cap unit and the failure of discharge resulting from dried ink is prevented by maintaining the discharge outlets in a wet state. Moreover, by discharging ink irrelevant to recording while performing recording, for example, viscosity of ink in all the discharge outlets is maintained to be constant, so that stable discharge capability is maintained.

When failure of discharge is generated, for example, the discharge outlets (nozzles) of the droplet discharging head 58 are sealed using the cap unit and air bubbles and the like experience suction along with ink from the discharge outlets through a tube using a suction unit. Ink, scum, and the like attached to a surface of the discharge outlets are removed by a cleaning unit and the carriage 55 recovers from the failure of discharge. The ink after the suction is discharged into a waste ink reservoir (not shown in the drawings) disposed on a lower portion of a body of the ink-jet recording device and the ink is absorbed and held in an ink absorber inside the waste ink reservoir.

In this manner, in the ink-jet (droplet discharging) recording device, the ink-jet recording head according to the present invention is installed, so that it is possible to perform high-quality recording at high speed. Further, it is possible to reduce power consumption in an entire portion of the ink-jet recording device due to high speed. In the above-mentioned embodiments, the present invention is applied to the ink-jet recording head. However, other than ink, it is possible to apply the present invention to a droplet discharging head discharging liquid resist for patterning.

The present invention is not limited to the specifically disclosed embodiment, and variations and modifications may be made without departing from the scope of the present invention.

The present application is based on Japanese priority application No. 2006-243100 filed Sep. 7, 2006, Japanese priority application No. 2007-187538 filed Jul. 18, 2007, the entire contents of which are hereby incorporated herein by reference.

What is claimed is:

1. A droplet discharging head comprising:

a common liquid chamber;

a plurality of liquid flow paths branching from the common liquid chamber, liquid in the common liquid chamber flowing through each liquid flow path of the plurality of liquid flow paths;

a nozzle communicating with the liquid flow path;

an actuator substrate having a heater disposed in the vicinity of the nozzle communicating with the liquid flow path; and an additional flow path on a surface above the liquid flow path in a vertical direction, the additional flow path branching from the liquid flow path so as to connect the common liquid chamber and the liquid flow path.

2. The droplet discharging head according to claim 1, wherein the actuator substrate has a concave portion on a portion of the surface above the liquid flow path in the vertical direction.

3. The droplet discharging head according to claim 2, wherein the concave portion is disposed adjacently to the heater on a common liquid chamber side.

4. The droplet discharging head according to claim 2, wherein the additional flow path is disposed on a position closest to the heater in the concave portion.

5. The droplet discharging head according to claim 2, wherein a convex portion is formed on a surface of the liquid flow path, the surface facing the concave portion.

6. The droplet discharging head according to claim 5, wherein a height of the convex portion is within a range from not less than ½ to not more than 2 times a height of the liquid flow path and the convex portion is not in contact with a surface where the concave portion is formed.

7. The droplet discharging head according to claim 5, wherein a position of the convex portion disposed in the liquid flow path is located upstream relative to a position of the additional flow path communicating with the common liquid chamber from the concave portion.

8. The droplet discharging head according to claim 2, wherein the additional flow path communicating with the concave portion and the common liquid chamber is formed by ICP dry etching process.

9. The droplet discharging head according to claim 1, wherein the additional flow path penetrates through the actuator substrate.

10. The droplet discharging head according to claim 1, wherein in the additional flow path, a diameter of an opening on a liquid flow path side is larger than a diameter of an opening on a common liquid chamber side and an upstream wall surface is formed to have an inclined surface.

11. The droplet discharging head according to claim 1, wherein the additional flow path is formed downstream relative to the heater.

12. The droplet discharging head according to claim 1, wherein a check valve preventing an air bubble from flowing backward is disposed in the common liquid chamber.

13. The droplet discharging head according to claim 1, wherein the additional flow path is configured to permit ejection of air bubble therethrough to the common liquid chamber.

14. The droplet discharging head according to claim 1, wherein the additional flow path is configured to permit ejection of air bubble therethrough from the liquid flow path side to the common liquid chamber side.

15. The droplet discharging head according to claim 1, wherein the droplet discharging head is configured to guide an air bubble in the liquid flow path side towards the additional flow path such that the air bubble can be passed through the additional flow path to the common liquid chamber.

16. The droplet discharging head according to claim 1, wherein for said each liquid flow path of the plurality of liquid flow paths, the corresponding nozzle communicates with said liquid flow path, and the corresponding additional flow path disposed on a surface above said liquid flow path in the vertical direction branches from the liquid flow path so as to connect the common liquid chamber and the liquid flow path.

17. A droplet discharging device comprising:

a droplet discharging head discharging a droplet, wherein a liquid cartridge using the droplet discharging head is installed on the droplet discharging device as the droplet discharging head including:

a common liquid chamber;

a plurality of liquid flow paths branching from the common liquid chamber, liquid in the common liquid chamber flowing through each liquid flow path of the plurality of liquid flow paths;

a nozzle communicating with the liquid flow path;

an actuator substrate having a heater disposed in the vicinity of the nozzle communicating with the liquid flow path; and an additional flow path on a surface above the liquid flow path in a vertical direction, the additional flow path branching from the liquid flow path so as to connect the common liquid chamber and the liquid flow path.

18. An image formation apparatus comprising:

a droplet discharging device using a liquid cartridge having a droplet discharging head including:

a common liquid chamber;

a plurality of liquid flow paths branching from the common liquid chamber, liquid in the common liquid chamber flowing through each liquid flow path of the plurality of liquid flow paths;

a nozzle communicating with the liquid flow path;

an actuator substrate having a heater disposed in the vicinity of the nozzle communicating with the liquid flow path; and an additional flow path on a surface above the liquid flow path in a vertical direction, the additional flow path branching from the liquid flow path so as to connect the common liquid chamber and the liquid flow path.

* * * * *